US005106028A

United States Patent [19]

Schenk et al.

[11] Patent Number: 5,106,028

[45] Date of Patent: Apr. 21, 1992

[54] CONTACT PRESSURE AND PARTING DEVICE FOR A METAL STRIP TO BE CONNECTED TO A WINDING REEL

[75] Inventors: Horst Schenk, Dortmund; Werner Sattler, Iserlohn, both of Fed. Rep. of Germany

[73] Assignee: Sundwiger Eisenhütte Maschinenfabrik Grah & Co., Hemer-Sundwig, Fed. Rep. of Germany

[21] Appl. No.: 549,441

[22] Filed: Jul. 6, 1990

[30] Foreign Application Priority Data

Mar. 16, 1990 [DE] Fed. Rep. of Germany ..... 4008445

[51] Int. Cl.[5] ..... B65H 19/28

[52] U.S. Cl. ..... 242/56 R

[58] Field of Search ..... 242/56 R, 78, 78.1, 242/78.3

[56] References Cited

U.S. PATENT DOCUMENTS

| | | | |
|---|---|---|---|
| 2,682,379 | 7/1954 | Piper et al. | 242/56 R |
| 3,744,730 | 7/1973 | Burnage | 242/56 R X |
| 3,794,255 | 2/1974 | Harmon et al. | 242/56 R |
| 4,798,351 | 1/1989 | Halter et al. | 242/56 R X |
| 4,919,351 | 4/1990 | McNeil | 242/56 R |

FOREIGN PATENT DOCUMENTS

| | | | |
|---|---|---|---|
| 0325506 | 7/1987 | European Pat. Off. . | |
| 159467 | 9/1940 | Fed. Rep. of Germany | 242/56 R |
| 2100959 | 7/1972 | Fed. Rep. of Germany | 242/56 R |
| 139244 | 12/1979 | German Democratic Rep. | 242/56 R |
| 1021489 | 6/1983 | U.S.S.R. | 242/56 R |
| 1390161 | 4/1988 | U.S.S.R. | 242/56 R |
| 757475 | 9/1956 | United Kingdom | 242/56 R |
| 2050317 | 1/1981 | United Kingdom | 242/56 R |

*Primary Examiner*—Daniel P. Stodola
*Assistant Examiner*—John P. Darling
*Attorney, Agent, or Firm*—Marmorek, Guttman & Rubenstein

[57] ABSTRACT

A contact pressure parting device for applying a continuously moving metal strip (1) to a winding reel (2). The contact pressure device comprises a contact pressure element (7) which is disposed on the rear side of the strip (1) remote from the winding reel (2) by which the strip (1) can be forced on to the winding reel (2), which is provided with an adhesive (3). The contact pressure and parting device also has a blade (8) which is disposed downstream of the contact pressure element (7), viewed in the direction of strip travel, and can be advanced against the rear side of the strip (1) and which when its cutting edge (8*a*) impinges on the strip (1) parts the strip (1), the blade (8) then being swung away from the strip (1) and the winding reel (2). In its starting position the cutting edge (8*a*) of the blade (8) is disposed upstream, viewed in the direction of strip travel, of the place (P) on the strip (1) situated closest to the pivoting axis (12) of the blade (8). Since as it is being swung away the blade (8) must pass through its zenith in relation to the strip (1), the strip (1) is reliably parted even when the blade is slowly advanced in its direction.

6 Claims, 1 Drawing Sheet

CONTACT PRESSURE AND PARTING DEVICE FOR A METAL STRIP TO BE CONNECTED TO A WINDING REEL

The invention relates to a contact pressure and parting device for a metal strip to be connected to a winding reel, constructed more particularly as a reversible reel, comprising a contact pressure element which is disposed on the rear side of the strip remote from the winding reel and by which the strip can be forced on to the winding reel, which is provided with an adhesive means, and a blade which is disposed downstream of the contact pressure element, viewed in the direction of strip travel, and can be advanced against the rear side of the strip and swung away in the direction of strip travel.

By means of such a known contact pressure and parting device (European Patent 0325306) the strip can in a problem-free manner be parted and connected to an empty winding reel even at high strip speeds of about 40 meters per second. Since the blade can be swung away, the strip is entrained in the direction of its travel and remains undamaged.

However, difficulties can occur in the parting of the strip if the blade is not advanced towards the strip fast enough, referred to the strip speed. In that case the strip may swing the blade away without the strip being parted.

It is an object of the invention so to improve the contact pressure and parting device of the kind specified that the speed at which the blade is advanced is not critical for the parting operation.

To this end according to the invention in its starting position the cutting edge of the blade is disposed upstream, viewed in the direction of strip travel, of the place on the strip closest to the pivoting axis of the blade.

In this way the blade impinges on the strip before it reaches its zenith, so that the strip does not swing the blade away, but during the swinging operation the cutting edge moves further on to the strip to boost the parting operation. The advanced blade cannot move back, since any such movement is counteracted by the moment inertia of the blade with the components, such as the blade holder, to be advanced in association with the blade.

To retain the blade in its starting position and also make the swinging movement possible, the blade should be preloaded in its starting position by a spring. Since during its swinging movement the blade is heavily accelerated, it should be protected against excessively heavy impingement by a stop cushion. The blade can be advanced towards the strip by a prestressed spring retained by a release catch.

Figure 2:
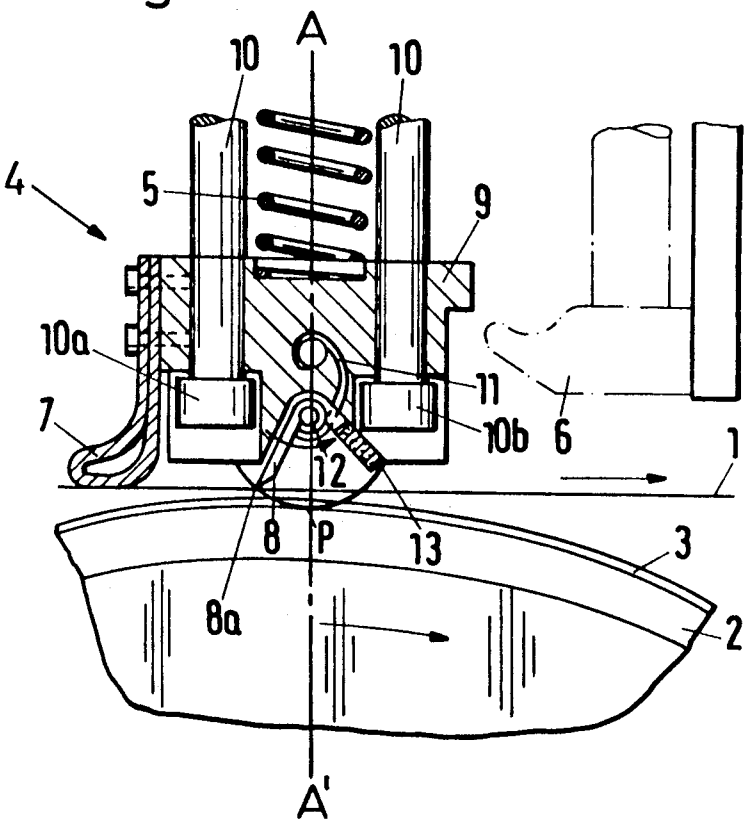
Figure 1:
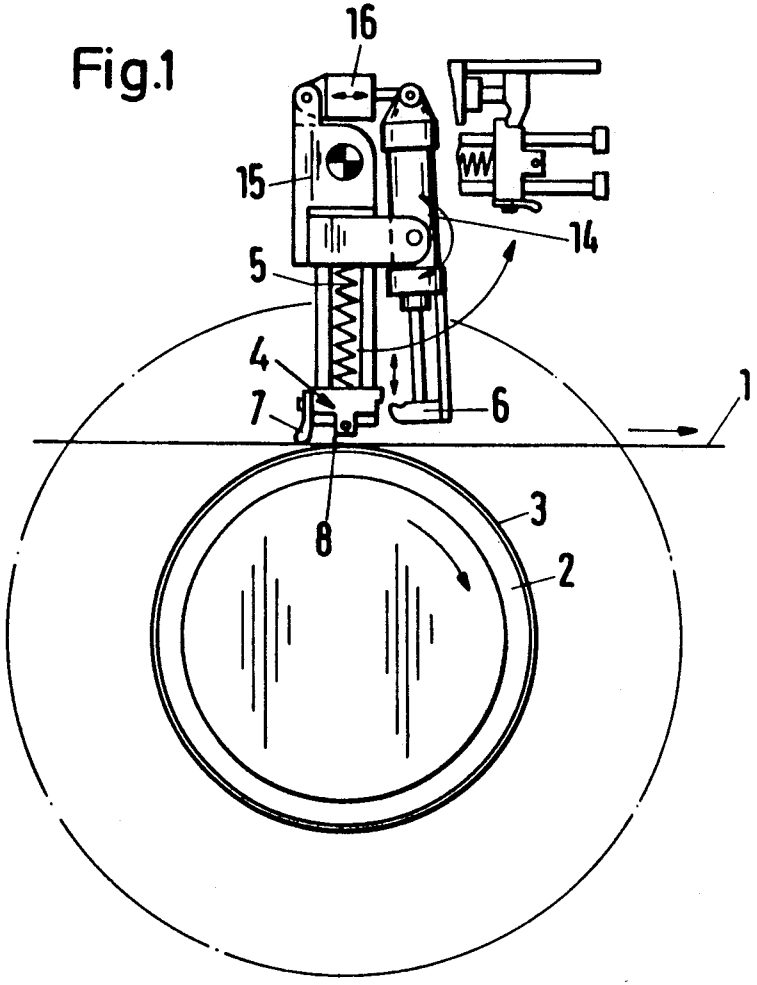

An embodiment of the invention will now be explained in greater detail with reference to the drawings, wherein:

FIG. 1 shows diagrammatically in side elevation and detail a contact pressure and parting device with an empty winding reel and a strip to be connected thereto, and FIG. 2 shows a detail to an enlarged scale of the contact pressure and parting device shown in FIG. 1.

A strip 1 to be parted is supplied to a winding reel (not shown). To prepare the parting operation, an empty winding reel 2 bearing on its surface an adhesive strip acting as an adhesion means 3 is pivoted into the vicinity of the strip 1. A contact pressure and parting device 4 is disposed on the rear side of the strip 1 remote from the winding reel 2. The device 4 is acted upon by a preloaded spring 5 in the direction indicated by an arrow—i.e., in the direction of the strip 1—and retained in the retracted position by a release catch 6.

The contact pressure and parting device 4 has as the contact pressure means, for example, a rubber-elastic loop 7 or a brush, and as the parting means a blade 8 having a, for example, serrated cutting edge 8*a*. The loop 7 and the blade 8 are borne by a holder 9 which is loaded by the spring 5 and mounted on a guide 10 with limiting stop 10*a*, 10*b*. As shown by the arrow, the blade 8 can be pivoted away against the force of a spring 11 around a axis 12 in the direction of travel of the strip 1. The axis 12 lies in a plane A—A′ which is perpendicular to the direction of travel of strip 1. In its starting position as shown in the drawing the cutting edge 8*a* of the blade 8 is disposed upstream, viewed in the direction of strip travel, of the point P of the strip 1 closest to the pivoting axis 12. Associated with the blade 8 is a stop cushion 13 on which the blade 8 entrained by the strip 1 during the parting operation is intercepted damped so that on the one hand the positioning of the blade 8 in relation to the winding reel 2 is not critical while on the other hand the strip is reliably parted at the zenith point P, the winding reel 2 should have a resilient winding surface into which the blade can penetrate during cutting. Merely the resilience of the adhesive strip 3 may be adequate for this purpose.

The release catch can be adjusted by means of a cylinder-and-piston arrangement 14 in the direction indicated by the double arrow. The cylinder-and-piston arrangement 14 is pivotably mounted on a holder 15, another cylinder piston 16 engaging with the cylinder-and-piston arrangement 14 for the pivoting movement. The release catch 6 is unlocked by means of the further cylinder piston 16. The first cylinder piston 14 returns the holder 9 for the loop 7 and the blade 8.

The contact pressure and parting operation is performed by means of the contact pressure and parting device according to the invention in the following manner: Having regard to the position of the adhesion means 3 on the generated surface of the winding reel 2, when the release catch 6 has been unlocked, the contact pressure and parting device 4 is so advanced by the spring 5 that the contact pressure element 7 forces the strip 1 against the winding reel 2 when the adhesion means 3 is in the zone of the contact pressure element 7. During such advance the cutting edge 8*a* impinges on the strip 1 and the blade 8 is entrained by the strip 1 in its direction of travel, the blade 8 being pivoted against the force of the spring 11. During the pivoting movement the cutting edge 8*a* moves further in the direction of the winding reel 2, thus boosting the parting operation to be performed by the cutting edge 8*a*. When the strip 1 has been parted and the fresh start of the strip has been glued to the adhesion means 3, the strip 1 is entrained by the winding reel 2. The blade 8 is first retained by a retaining means (not shown) in the pivoted position. When the holder 9 with the contact pressure means 7 and the blade 8 has been moved back by the piston-and-cylinder units 14, 16, the retaining means for the blade 8 can also be released, so that its spring 11 moves the blade 8 back into the starting position shown in the drawing. Then the whole contact pressure and parting device is pivoted through 90° into the position shown.

The special advantages achieved by the invention are that the strip 1 is parted in a problem-free manner even at high strip speeds, and the fresh start of the strip is reliably glued to the empty winding reel. After the gluing, the contact pressure element in the form of the loop 7 allows the strip 1 to slide through, while the blade 8 is swung away from the strip 1 and is kept swung away by a locking means (not shown), so that it cannot damage the strip 1. The parting operation is reliable, since the speed of the advanced compact pressure and parting device 4 is no longer decisive for the parting operation.

We claim:

1. A contact pressure and parting device for applying a moving strip having a direction of travel to a winding reel, comprising a blade holder, a contact pressure element mounted on said blade holder for urging said moving strip against said winding reel, a blade mounted on said blade holder at a location which is downstream of said contact pressure element when viewed along the direction of travel of said strip, and means for moving said blade holder so as to bring said blade into and out of contact with said strip for cutting said strip, said blade being mounted in said blade holder so as to be rotatable in said blade holder about an axis which lies in a first plane which is perpendicular to the direction of travel and in a second plane which is parallel to said strip, said blade being oriented initially in said blade holder so that said blade initially contacts said strip at a position which is upstream of the closest point between said strip and said axis when viewed along the direction of travel of said strip, said blade thereafter being caused to rotate about said axis by the movement of said strip and being caused to dig into said strip during said rotation to aid in cutting said strip.

2. The device of claim 1 further comprising adhesive means associated with said winding reel for adhering said strip to said winding reel.

3. The device of claim 1 further comprising a spring associated with said blade, said spring urging said blade into its initial orientation.

4. The device of claim 1 further comprising a stop cushion mounted in said blade holder so as to limit the rotational movement of said blade.

5. The device of claim 1 wherein said means for bringing said blade into and out of contact with said strip comprises a prestressed spring retained by a release catch.

6. The device of claim 5 wherein said means for bringing said blade into and out of contact with said strip further comprises a piston-cylinder arrangement which engages and disengages said release catch against said blade holder.

* * * * *